United States Patent [19]

Mattei

[11] Patent Number: 4,640,656

[45] Date of Patent: Feb. 3, 1987

[54] DEVICE FOR SUPPLYING ROD-SHAPED ARTICLES, FOR EXAMPLE CIGARETTES, TO A PROCESSING MACHINE

[75] Inventor: Riccardo Mattei, Bologna, Italy

[73] Assignee: G. D. Societa per Azioni, Bologna, Italy

[21] Appl. No.: 762,545

[22] Filed: Aug. 2, 1985

[30] Foreign Application Priority Data

Oct. 11, 1984 [IT] Italy ..... 3600 A/84

[51] Int. Cl.[4] ..... B65G 65/23

[52] U.S. Cl. ..... 414/303; 198/535; 198/631; 414/414; 414/419

[58] Field of Search ..... 414/303, 425, 403–405, 414/414, 419–421; 198/631, 535; 131/282, 909

[56] References Cited

U.S. PATENT DOCUMENTS

| | | | |
|---|---|---|---|
| 3,595,413 | 7/1971 | Hillman | 414/414 X |
| 3,854,611 | 12/1974 | Wahle | 414/414 |
| 3,883,017 | 5/1975 | Shirai et al. | 414/414 |
| 3,989,199 | 11/1976 | Seragnoli | 414/414 |
| 4,042,094 | 8/1977 | Schmermund | 131/282 X |
| 4,069,930 | 1/1978 | Atwell et al. | 414/421 X |
| 4,278,385 | 7/1981 | Bardenhagen et al. | 414/419 |
| 4,303,366 | 12/1981 | Hinchcliffe et al. | 414/421 X |
| 4,352,604 | 10/1982 | Carascon et al. | 131/282 X |
| 4,534,157 | 8/1985 | McGill et al. | 198/631 X |

*Primary Examiner*—Joseph E. Valenza
*Assistant Examiner*—David A. Bucci
*Attorney, Agent, or Firm*—Karl F. Ross; Herbert Dubno

[57] ABSTRACT

A device for supplying cigarettes (5) to a packaging machine is provided with a rotary head (3) for tipping containers (4) full of cigarettes (5) into a tank (6) whose base is formed by an upper branch (38) of a conveyor (7) for supplying a continuous flow of cigarettes (5) to the packaging machine. After each container (4) has been emptied and while it is being replaced by a new container full of cigarettes (5), the branch (38) of the tank base is raised by a displacement device (47–49) provided with an alternating vertical movement such that the mass of cigarettes (5) is raised towards the mouth of the tank (6) and consequently such that there is a reduction of the jump performed by the cigarettes (5) at the moment of opening of the base of the new container (4) for its discharge into the tank (6).

6 Claims, 3 Drawing Figures

DEVICE FOR SUPPLYING ROD-SHAPED ARTICLES, FOR EXAMPLE CIGARETTES, TO A PROCESSING MACHINE

The present invention relates to a device for supplying rod-shaped articles, for example cigarettes, to a processing machine.

The present invention relates, in particular, to a device in which containers full of cigarettes are individually upturned so as to pour, via one of their ends, or a discharge mouth, their contents into a tank which communicates at its base, by means of a conveyor belt, with the input hopper of a processing machine, for example a cigarette packaging machine.

At the discharge mouth of the containers there are provided detachable retaining means constituted by a plate able to move, by means of a movement about its axis of rotation, from a closed position designed to prevent the discharge of the cigarettes during the overturning operation, to an open position designed to enable the cigarettes to be discharged into the tank.

After each container has been emptied, it is replaced by a further container full of cigarettes which is in turn overturned over the tank.

The operation for replacing the empty container with a full container requires, however, a certain amount of time during which the packaging machine continues to operate and the level of the cigarettes in the tank consequently decreases.

As mentioned above, at the time of removal of the container means from the discharge mouth of each container, the cigarettes contained therein fall into the tank thereby causing a change in level as a result of which they are frequently incorrectly disposed with respect to the underlying mass of cigarettes.

The object of the present invention is to supply a device of the above-mentioned type which does not have the drawback mentioned above, i.e. a device in which the cigarettes, at the time of opening of the discharge mouths of the containers, are correctly disposed above the mass of cigarettes contained in the tank.

This object is achieved by the present invention which relates to a device for supplying rod-shaped articles, for example cigarettes, to a processing machine, comprising means for supplying containers for these articles above a tank, retaining means associated with these containers, which means may be moved between a closed position and an open position of a discharge mouth of the containers, a conveyor, which forms the base of the tank, for supplying a continuous flow of these articles to the processing machine, characterized in that it comprises means for displacing this base in a reciprocating manner in a substantially vertical direction, and means for detecting the level of the articles in the tank and for controlling the displacement means.

Figure 1:
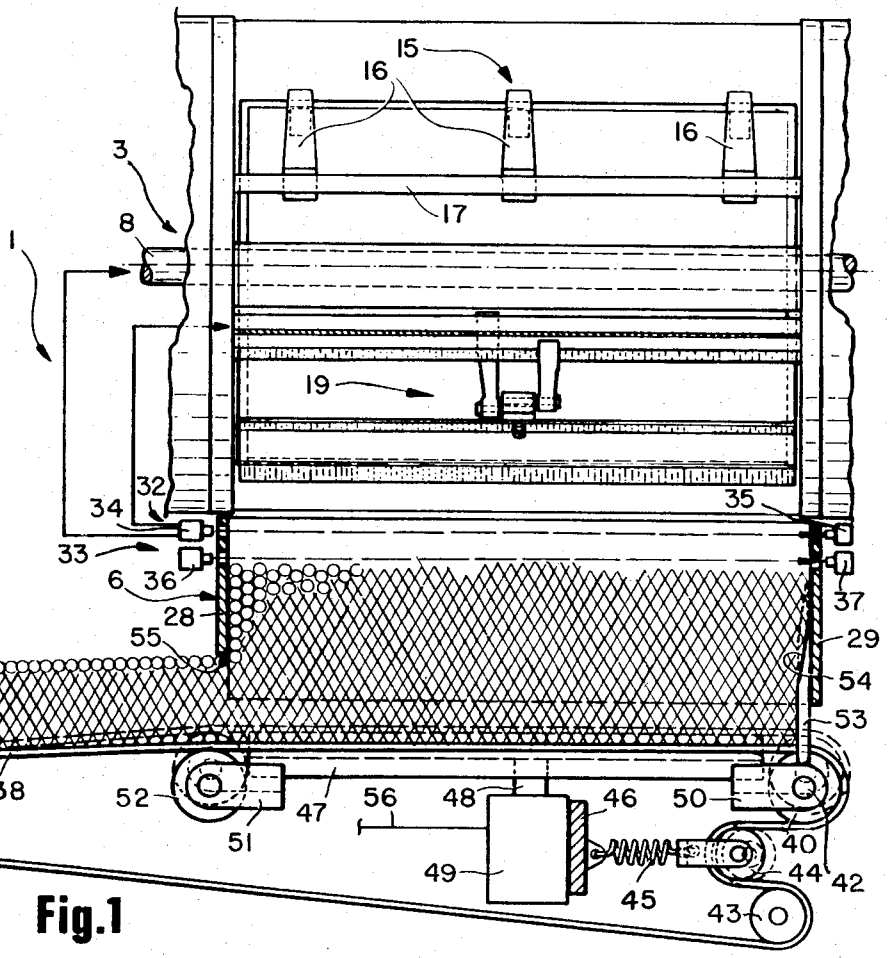
Figure 2:
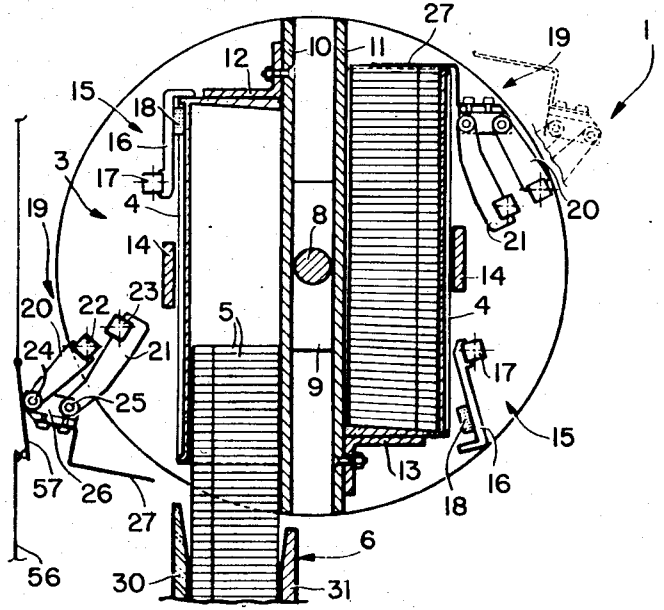
Figure 3:
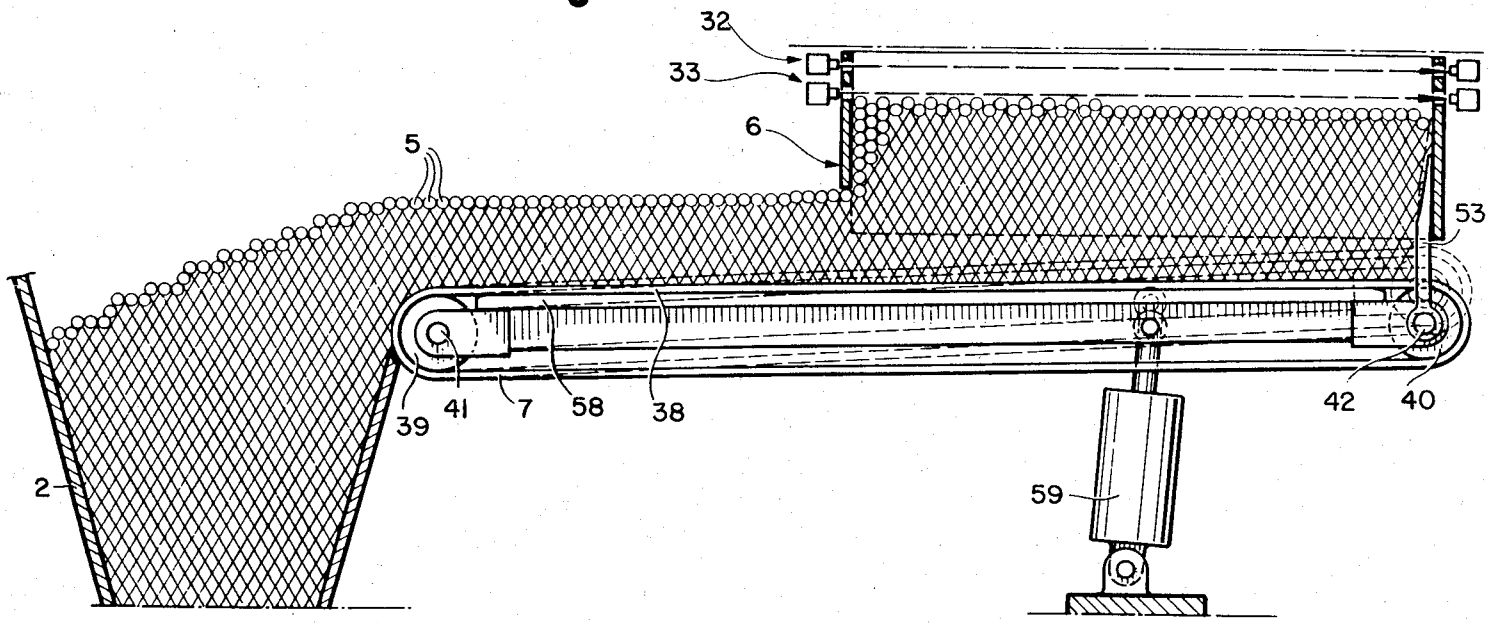

The present invention will now be described with reference to the attached drawings which show an embodiment thereof, purely by way of non-limiting example, in which:

FIG. 1 is a diagrammatic front view of a device for supplying rod-shaped articles constructed in accordance with the present invention, FIG. 2 is a diagrammatic sectional view of a detail of the device of FIG. 1, and FIG. 3 shows a second embodiment of the device of the present invention.

With reference to FIG. 1 in particular, a device for supplying cigarettes to a hopper 2 of a packaging machine (not shown) is designated overall by 1.

This device comprises means for supplying rod-shaped articles constituted by a head 3 for supporting and overturning containers 4 of cigarettes 5 into a tank 6 disposed above a closed circuit belt conveyor designated overall by 7.

The head 3 (see also FIG. 2) is supported by a horizontal shaft 8 supported in a way which is not shown and connected to discontinuous operating means of known type which cause it to rotate through 180° each time they are actuated.

On the shaft 8 there is keyed a block 9 supporting two walls 10 and 11 disposed on either side of the shaft 8 and parallel thereto.

Each of the walls 10, 11 defines, in combination with a corresponding bracket 12, 13 perpendicular thereto and facing towards the exterior of the head 3, a compartment for receiving a container 4.

These compartments are asymmetrical with respect to a plane passing through the axis of the shaft 8 such that, as shown in FIG. 2, the head 3 may simultaneously contain two containers 4, the first of which is upturned with its end or discharge mouth facing the tank 6 and the second of which is upright and ready to replace the first following a rotation of the shaft 8 through 180°.

Each of the containers 4 is kept in the correct position in the respective compartment by a respective plate 14, parallel to the walls 10 and 11 and forming part of the head 3.

In the vicinity of the brackets 12 and 13 there are provided elements 15 for locking the containers 4 in their respective compartments. Each locking element 15 comprises three arms 16 rigid with a same shaft 17 parallel to the shaft 8 and provided with an oscillating rotary movement about its axis by means of motor means (not shown).

These arms 16, provided on the side facing the respective compartment with a buffer 18 of resilient material and having their free ends folded at right angles towards the rotary head 3 may be moved between a locking position in which they are adjacent to one side and the base of the container 4 and a position in which they are disengaged from the respective compartment.

At the discharge mouth of each container 4 housed in the head 3 there is disposed a member 19 for containing the cigarettes 5.

Each container member 19 comprises two substantially parallel connecting rods, 20 and 21 respectively, each having one end connected to a respective spindle 22, 23 parallel to the shaft 8 and supported in a way which is not shown by means rigid with the rotary head 3.

The free ends of each pair of connecting rods 20 and 21 are connected, via pins 24 and 25, by a rod 26 to which there is fixed a plate 27.

The two spindles 22 and 23, associated with each container member 19 are provided with motor means (not shown) providing them with an oscillating rotary movement about their respective axes and form, together with the connecting rods 20, 21, the rod 26 and the pins 24, 25, an articulated quadrilateral by means of which the plate 27 is provided with a reciprocating movement between two end positions in which the plate 27 of the discharge mouth of the respective container 4 is respectively open and closed.

The tank 6 for receiving the cigarettes 5 from the container 4 in the discharge position is laterally bounded (see FIG. 1) by two vertical walls 28 and 29 and at the front and the rear (see FIG. 2) by two vertical walls 30 and 31 respectively.

The tank 6 is associated with two devices for detecting the level of the cigarettes contained therein, shown, moving upwardly, by 32 and 33.

Each of the control devices is formed by an emitter and a receiver of light radiation which are horizontally aligned and shown, for the device 32, by 34 and 35 and, for the device 33, by 36 and 37.

The base of the tank 6 is formed by an upper branch 38 of the conveyor 7, extending between two end rollers 39 and 40 mounted on respective shafts 41 and 42 which are horizontal and perpendicular to the axis of rotation of the rotary head 3.

Whereas the roller 40 is substantially in vertical alignment with the wall 29 of the tank 6, the roller 39, driven in the anti-clockwise direction looking at FIG. 1, is disposed externally to the base of the tank 6 in the vicinity of the hopper 2 of the cigarette packaging machine.

The conveyor 7 is closed at the base in the form of a ring about a return roller 43 and is kept tensioned by a belt-tensioning roller 44 whose axis is connected resiliently, via a spring 45, to a fixed plate 46.

At the base of the tank 6, the branch 38 is supported in a slidable manner by a horizontal plate 47 mounted on a vertical output shaft 48 of an actuator or displacement means 49.

The plate 47 supports at one end, via a bracket 50, the said roller 40 and at its other end, in vertical alignment with the wall 28 of the hopper 6, by means of a bracket 51, a second roller 52 identical to the first.

The bracket 50 has fixed to it a vertical plate 53 adjacent within the tank 6 to the vertical wall 29 and sharpened to a point at the top as a result of a bevel 54 provided on its side facing the interior of the tank 6.

While the plate 53 forms a connection element between the wall 29 of the tank 6 and the base branch 38, the second lateral wall 28 defines, with respect to this branch 38, a passage 55 which enables the outlet of the cigarettes 5 from the tank 6 and their supply to the hopper 2 of the packaging machine.

It is now assumed that the device 1 of the present invention is disposed, in its operating condition, in the position shown in FIG. 1, in which the plate 27, in the retracted position, enables the emptying of the container 4 into the tank 6, whilst the branch 38, in its lower position shown by a continuous line, supplies, via the passage 55 a continuous flow of cigarettes 5 to the hopper 2 of the packaging machine.

At the time at which, after the complete emptying of the container 4, the level of the cigarettes 5 in the tank 6 drops below the operating line of the control device 32, this device supplies a control signal to the motor (not shown) associated with the shaft 8 which rotates through 180° about its axis and changes the position of the two containers 4 in the head 3.

In the time required for these operations and the removal of the plate 27 from the base of the new container 4 for the discharge of the cigarettes 5 contained therein, the packaging machine continues to operate and the level of the cigarettes 5 in the tank 6 consequently drops.

As soon as this level drops below the operating line of the lower control device 33, the latter supplies a control signal to the actuator 49, which provides the shaft 48, and consequently the plate 47 and the rollers 52 and 40, with a vertical lifting movement.

The branch 38 is consequently raised together with the superposed mass of cigarettes 5, and when the level of the cigarettes 5 in the tank 6 reaches the level of the control device 32, cutting off the radiation emitted by the emitter 34, a stop signal is supplied to the actuator 49 and a control signal to the motor means associated with the container member 19 for the cigarettes 5 in the container 4 in the discharge position.

Following the rotation in a clockwise direction of the two connecting rods 20 and 21 on respective pivots, the plate 27 projects from the container 4.

The articulated quadrilateral connection described above enables the plate 27 to move into its disengaged position along a predominantly horizontal path and provides it in the meantime with a vertical movement of very limited amplitude, but sufficient to remove it from contact with the cigarettes 5 in the container 4.

The cigarettes 5 are therefore free to drop under the action of gravity from the container 4 into the tank 6, without being in any way hindered by the container element 19, and carrying out, as a result of the raising of the belt 38, a very small jump which does not provide sufficient time for the cigarettes 5 to assume incorrect positions.

It should be noted that the characteristics of this path also enable the inlet mouth of the tank 6 to be disposed with a spacing from the discharge mouth of the container 4 which is lower than the distance encountered in known devices, in which the retaining elements are displaced by rotation about an axis, i.e. following a path in the shape of a circular arc.

During the emptying of the container 4 into the tank 6, the actuator 49 which leads, via a line 56, to a switch 57 actuated by the container element 19, brings the branch 38 back into its lower end of stroke position and ready for a further operating cycle as described above.

It should be noted that the raising of the branch 38 to its upper position, shown in dashed lines in FIG. 1, causes the belt-tensioning roller 44 to slide into the position shown in dashed lines in FIG. 1.

In this way the tension of the conveyor belt 7 is not modified.

During this lifting operation, the plate 53 is brought into an upper position shown in dashed lines in FIG. 1, sliding between the wall 29 of the tank 6 and the mass of cigarettes 5 without damage to the latter as a result of the bevel 54 with which it is provided.

In the embodiment shown in FIG. 3, the conveyor belt 7 is supported by a support means formed by a plate 58 which rotates, under the action of a displacement means or actuator 59 actuated by conventional control means 33, about the axis 41 of the motor roller 39.

More precisely, a rotation of the plate 58 in the anti-clockwise direction corresponds, looking at FIG. 3, to a substantially vertical raising of the branch 38, whilst a rotation of the plate in the clockwise direction corresponds to a lowering of this branch.

I claim:

1. A device for supplying rod-shaped articles, for example cigarettes, to a processing machine, comprising means for supplying containers of these articles above a tank, retaining means associated with the containers and movable between a closed position and an open position of a discharge mouth of the containers, a conveyor forming the base of the tank for supplying a continuous flow of articles to the processing machine, means for displacing at least the portion of said conveyor under the tank with a reciprocating movement in a substantially vertical direction, and detection means for detecting the level of the articles in the tank and for controlling the displacement means.

2. A device as claimed in claim 1, characterized in that the displacement means is provided with a vertical alternating movement.

3. A device as claimed in claim 2, characterized in that the displacement means comprise a slide plate for the conveyor and at least one return roller engaged with the conveyor.

4. A device as claimed in claim 1, characterized in that the displacement means comprise means for supporting the conveyor provided with an oscillating movement.

5. A device as claimed in claim 1, characterized in that it comprises second detection means for the level of the articles in the tank, for stopping the displacement means and for controlling the opening of the retaining means.

6. A device as claimed in claim 1, characterized in that the retaining means are formed by plates leading to a respective actuation means via articulated quadrilateral connections.

* * * * *